United States Patent [19]

Kuelzer

[11] 4,051,940

[45] Oct. 4, 1977

[54] MOSAIC NEEDLE PRINTER HEAD USING PLUNGER ARMATURE SOLENOID ARRANGEMENTS

[75] Inventor: Peter Kuelzer, Munich, Germany

[73] Assignee: Siemens Aktiengesellschaft, Berlin & Munich, Germany

[21] Appl. No.: 603,937

[22] Filed: Aug. 12, 1975

[30] Foreign Application Priority Data

Aug. 14, 1974 Germany ..... 2439098

[51] Int. Cl.[2] ..... B41J 3/44

[52] U.S. Cl. ..... 197/1 R; 29/525; 101/93.05

[58] Field of Search ..... 197/1 R; 335/255; 29/450, 451, 525; 101/93.04, 93.05

[56] References Cited

U.S. PATENT DOCUMENTS

| | | | |
|---|---|---|---|
| 2,214,491 | 9/1940 | Tondeur | 29/451 X |
| 3,046,824 | 7/1962 | Mohr | 29/525 X |
| 3,058,764 | 10/1962 | Scott et al. | 29/525 X |
| 3,672,482 | 6/1972 | Brumbaugh et al. | 197/1 R |
| 3,787,791 | 1/1974 | Borger et al. | 197/1 R X |
| 3,850,278 | 11/1974 | Mihm et al. | 197/1 R |
| 3,897,865 | 8/1975 | Darwin et al. | 197/1 R |

*Primary Examiner*—Ralph T. Rader

*Attorney, Agent, or Firm*—Hill, Gross, Simpson, Van Santen, Steadman, Chiara & Simpson

[57] ABSTRACT

A printer needle-plunger armature assembly for use in a mosaic needle printer head. The printer needle is secured to the plunger armature by virtue of a connection which includes a blind bore formed in the armature and lateral deformation formed on an end portion of the needle which is inserted into the blind bore, which deformations are straightened upon said insertion. Inserts including a helically wound wire coil may be disposed within the blind bore for receiving the end portion of the printer needle.

3 Claims, 11 Drawing Figures

MOSAIC NEEDLE PRINTER HEAD USING PLUNGER ARMATURE SOLENOID ARRANGEMENTS

BACKGROUND OF THE INVENTION

The present invention relates generally to the field of printer heads and more particularly to a mosaic needle printer head which uses printer needles actuated by the armatures of solenoid systems.

Some solenoid-operated mosaic needle printer heads utilize plunger armatures for actuating the printer needles during a printing operation. Thus the printing needles are rapidly reciprocated, being moved first in one direction upon excitation of the armature and then in an opposite direction by virtue of the biasing effect of a return spring.

In the manufacture of mosaic printer mechanisms, the attachment between the printer needles and the armatures of the individual electromagnetic systems presents a particularly vexing problem. One reason for this problem is the special fineness of the printer needles used in mosaic printers, the diameters of which are lessthan 0.4 mm. Another reason resides in the nature of the material of both the printer needle and the electromagnetic armatures. The material of which the printer needles are made must be extremely wear-resistant and breakage-resistant to produce a long useful like. Such materials, however, (as experience has shown) cannot be united with one another nor with other materials, such as, for example, those of electromagnetic armatures which must of necessity have good ferromagnetic properties, without great difficulty, and even then generally only to an incomplete extent. When plunger armatures are used in the solenoid systems for the actuation of the printer needles further difficulties in attachment between the printer needles and the armatures arise by virtue of the fact that in order to attach the printer needles to the plunger armatures, the latter must be provided with bores of correspondingly small diameters and adequate depth, formed centrally in the armatures. The manufacture of such bores to the requisite tolerances is an extremely expensive operation.

Welded and soldering connections are equally as expensive but in addition provide an additional problem in that damage to the structural materials may result as a consequence of the application of heat which is required in soldering and welding operations.

The connection problem is further compounded by the fact that in all circumstances it is necessary that the printer needle and the plunger armature are precisely axially aligned since otherwise the armature could cross-bind in the coil of the solenoid.

Unfortunately, the printer needles cannot be simply press-fit into the plunger armatures since, because of the small diameters involved, the materials do not have sufficient elasticity to produce a satisfactory frictional bond.

An object of the present invention is to provide a mosaic needle printer head which employs plunger armature solenoid systems and in which the connection between the printer needles and the plunger armatures are provided simply and inexpensively, while at the same time the connection is completely satisfactory and reliable.

SUMMARY OF THE PRESENT INVENTION

A mosaic needle printer head which satisfies the foregoing requirements and which is constructed in accordance with the principles of the present invention comprises means forming a blind bore in the plunger armature, an end portion on the printer needle which is inserted into the blind bore and elastically deformable means for securing the end portion of the printer needle within the blind bore.

The principles of the present invention make use of the fact that the forces acting upon the plunger armature and printer needle vary radically in accordance with the direction of movement, so that different retaining forces can be restored to for reliable attachment between the printer needle and the plunger armature. Relatively very high forces occur between the printer needle and the plunger armature during a printing operation. These forces, in accordance with the principles of the present invention, are transmitted fully mechanically, since the printer needle is supported across its entire cross-sectional area at the end thereof which abuts the base or end wall of the blind bore formed in the plunger armature.

During the return movement of the plunger armature and consequently of the printer needle, and regardless of the small masses involved, the high velocities result in considerable forces being exerted at the point of attachment between the plunger armature and the printer needle. These forces are, however, substantially less than those which occur when the printing of character elements is taking place. Consequently, to absorb these forces, frictional connections between the printer needle and the plunger armature are adequate, and the requisite frictional forces can be established by using elastically deformable means.

Thus, by utilizing the mechanical connection which occurs at the base of the blind bore, in order to absorb the high printing forces, and by using elastically deformable means in order to transfer the return forces through the cylindrical side walls of the blind bore, an arrangement constructed in accordance with the principles of the present invention can be produced cheaply and completely reliably.

In a preferred embodiment of the invention the mosaic needle printer head is characterized in that the end portion of the printer needle which extends into the blind bore of the plunger armature is formed with lateral deformations which are elastically straightened out upon insertion of the end portion into the blind bore. The lateral deformations formed upon the inserted end portions of the printer needles give rise, as a consequence of their elasticity, to the requisite frictional bond between the printer needle and the plunger armature.

Because of the unusually small diameter of the printer needle, it is preferable to insert a small diameter tubular insert into the blind bore of the plunger armature rather than to drill a small diameter bore directly into the plunger armature. Thus while it is quite expensive to drill an extremely small diameter bore into the plunger armature, the manufacture of tubing having a small diameter bore is not, relatively speaking, as expensive. Thus the tubular insert serves as a diameter reducer member between the larger diameter bore of the plunger armature and the smaller diameter of the printer needle.

In another embodiment of the present invention the end portion of the printer needle which is inserted into the blind bore is laterally deformed and inserted into the inner bore or eye of a helically wound wire coil which is disposed within the blind bore of the plunger armature. The axial extent of the laterally deformed end portion of the printer needle is supported by the wire coil except for the terminus thereof which extends beyond the coil and is in direct abutting engagement with the end wall or base of the blind bore. Once again, as the end portion of the printer needle is being inserted into the eye of the wire it is straightened out as a consequence of its elastic properties. This embodiment of the invention also enables the blind bore to be formed with a relatively large diameter, thus reducing the expense of manufacture. The helically wound wire securely grips the cylindrical wall of the blind bore and as a consequence of the elastic forces developed by the deformations formed on the end portion of the printer needle, the retaining forces between the printer needle and plunger armature are further reinforced.

In another embodiment of the invention the printer needle is secured within the blind bore of the armature in a roll pin which is bent U-fashion. This arrangement, once again, enables an inexpensive means of attachment between the printer needle and the plunger armature which results from the fact that the blind bore formed in the plunger armature is of a diameter which is larger than that of the printer needle but is provided with an insert which is relatively simple to manufacture to provide a secure gripping relation between the plunger armature and the printer needle.

Many other features, advantages and additional objects of the present invention will become manifest to those versed in the art upon making reference to the detailed description which follows and the accompanying sheets of drawings, in which preferred structural embodiments incorporating the principles of the present invention are shown by way of illustrative example only.

BRIEF DESCRIPTION OF THE DRAWING

FIGS. 2*a*–4*a* are similar to FIG. 1*a* but illustrate other embodiments of the printer needle of the present invention.

DESCRIPTION OF THE PREFERRED EMBODIMENTS

Figure 1:
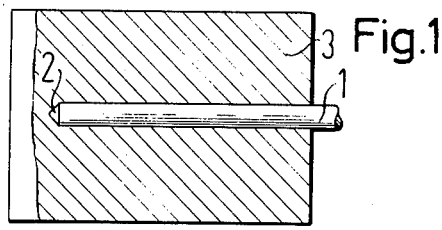
FIG. 1 illustrates a printer needle-plunger armature assembly constructed in accordance with the principles of the present invention, with the major portion of the plunger armature shown in section.
Figure 1A:
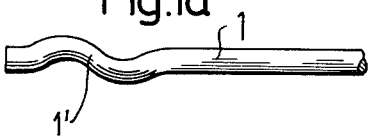
FIG. 1*a* is an elevational view of the printer needle shown in FIG. 1 before it is inserted into the plunger armature.

Referring first of all to the embodiment of the invention shown in FIGS. 1 and 1*a*, a printer needle 1 is shown in FIG. 1*a* in its free or natural state or condition, and in such state comprises a corrugated end porton 1' which, in the assembled condition thereof, is inserted into a blind bore 2' formed in a plunger armature 3. It is apparent from the drawings that as the printer needle 1 is inserted into the bore 2' the corrugated end porton 1' thereof is straightened out and conforms substantially to the shape of the bore 2'. An end wall of the printer needle 1 abuts a blind end wall 2 of the bore 2', and upon insertion of the printer needle 1 into the bore 2' the corrugated end porton 1', by virtue of its elasticity, imposes a radial force upon the walls of the bore 2'. This radial force produces a frictional or gripping action or connection between the printer needle 1 and the plunger armature 3, thereby preventing retraction of the printer needle 1 from the blind bore 2 within a range of forces which is not exceeded by the return forces acting upon the printer needle 1 through the plunger armature 3 during a printing operation. In order to transmit the higher printing forces, the printer needle 1 mechanically and directly abuts the base of the blind bore 2.

Figure 2:
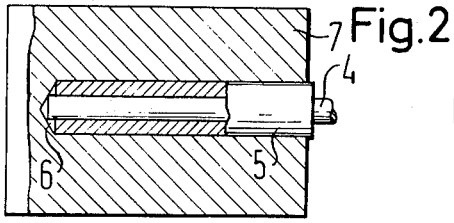
FIGS. 2–4 are similar to FIG. 1 and illustrate other embodiments of the printer needle-plunger armature assembly of the present invention.
Figure 2A:
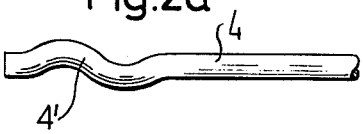

Referring to FIGS. 2 and 2*a*, a corrugated end portion 4' of a printer needle 4 is inserted into a blind bore 6 formed in a plunger armature 7, but instead of directly contacting the walls of the blind bore 6 the corrugated end portion 4' abuts, in the assembled condition thereof, a tubular insert 5 which is disposed within the blind bore 6. By virtue of the interposition of the tubular insert 5, which serves as a reducer piece, between the diameter of the blind bore 6 and the diameter of the printer needle 4, the diameter of the blind bore 6 can be of sufficiently large size such that the production thereof does not constitute an expensive machining operation.

Figure 3:
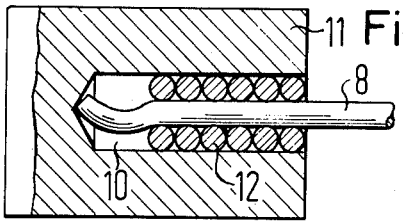
Figure 3A:
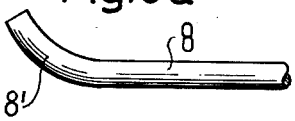
Figure 4:
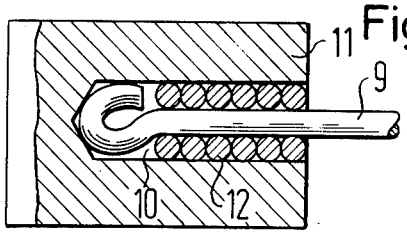

FIGS. 3 and 4 are illustrative of printer needle-plunger armature assemblies in which a helically wound wire is inserted in the armature bores for retention of the printer needles. Thus, referring to FIG. 3*a*, a printer needle 8 is formed with an arcuately shaped or bent end portion 8'. As shown in FIG. 3, a helically wound wire coil 12 is inserted into a blind bore 10 of a plunger armature 11, and the printer needle 8 is inserted through the eye of the wire coil 12. As the end portion 8' of the printer needle 8 passes through the eye of the coil it is, of course, elastically deformed and straightened but as noted, the axial extent of the wire coil 12 is less than that of the blind bore 10, such that a small axial extent of the printer needle 8 is inserted beyond the wire coil 12 and returns to a bent condition and directly abuts the base of the blind bore 10.

Figure 4A:
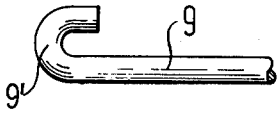

Referring to FIGS. 4 and 4*a*, a printer needle 9 has an end portion 9' which is arcuately shaped to bend over and overlie the main portion of the printer needle 9. In this embodiment of the invention the end portion 9' is straightened and then inserted into a helically wound wire 12 disposed within the blind bore 10 of the plunger armature 12, and upon complete insertion of the printer needle 9 the end portion 9' again attains the free state condition thereof shown in FIG. 4*a* to the extent permitted by virtue of the confining action of the helically wound wire 12 and the walls of the blind bore 10. It will therefore be appreciated that the configuration of the end portion 9' within the blind bore 10 serves to provide the requisite retaining force for preventing the printer needle 9 from becoming removed from or being axially displaced with respect to the plunger armature 11.

Figure 5:
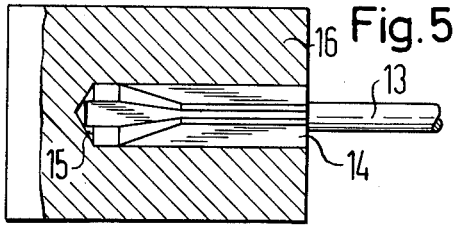
FIG. 5 is similar to FIG. 1 but discloses another arrangement of the present invention.
Figure 5A:
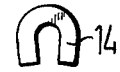
FIG. 5*a* is an end elevational view of a roll pin shown in FIG. 5.
Figure 6:
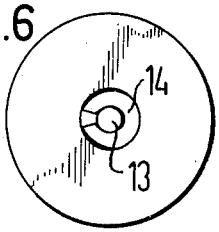
FIG. 6 is an end elevational view of the arrangement shown in FIG. 5.

Referring to FIG. 5, a printer needle 13, cylindrically shaped in the free state condition thereof, is inserted into a roll pin 14 which, as noted in FIG. 5*a*, is bent into U-fashion in the free state condition thereof. Upon insertion of the roll pin 14 into the blind bore 15 of the plunger armature 16, however, the roll pin assumes a generally cylindrical configuration, as shown in FIG. 6. The elastic deformation of the roll pin 14 and the frictionally imposed load which is imposes upon the walls of the blind bore 15 and the printer needle 13 produces the requisite retaining force for maintaining the printer needle 13 within the plunger armature 16.

Although minor modifications might be suggested by those versed in the art, it should be understood that I wish to embody within the scope of the patent warranted hereon all such modifications as reasonably come within the scope of my contribution to the art.

What I claim is:

1. In a printer needle-plunger armature assembly for use in a mosaic needle printer head including a solenoid-actuated plunger armature and a printer needle operatively secured thereto, the improvement comprising means for connecting said printer needle and plunger armature in assembled relation, said connecting means comprising wall means forming a blind bore and an end wall in said plunger armature, means forming an end portion on said printer needle for insertion into said bore for abutment with said end wall, said connecting means including elastically deformable gripping means for holding said end portion of said printer needle in said bore, and means forming a helically wound wire disposed in said blind bore and having a longitudinal dimension less than the corresponding dimension of said bore whereby said end wall of said bore and the inner end of said helically wound wire are disposed in spaced relation, said elastically deformable gripping means comprising a lateral deformation formed at the terminus of said end portion of said printing needle, said lateral deformation being straightened from a deformed condition to a straight condition upon being inserted into said helically wound wire and again assuming its deformed condition after it passes through said helically wound wire into the space in said bore between said end wall and said helically wound wire.

2. The invention as defined in claim 1 wherein said lateral deformation extends radially outwardly beyond the diameter of said helically wound wire.

3. In a printer needle-plunger armature assembly for use in a mosaic needle printer head, including a solenoid actuated plunger armature and a generally cylindrical printer needle secured thereto, the improvement wherein said printer needle is secured to said plunger armature by means forming a cylindrical blind bore in said plunger armature, said blind bore having a transverse inner end wall and said printer needle having an end portion of substantially the same diameter as said bore, said end portion having a corrugated configuration in a free state condition and assuming a configuration corresponding to said bore in a secured state condition upon insertion into said bore and into abutment with said end wall.

* * * * *